US006573485B2

(12) United States Patent
Yokozeki

(10) Patent No.: US 6,573,485 B2
(45) Date of Patent: Jun. 3, 2003

(54) INDUCTION HEATING ROLLER APPARATUS OF IMAGE FORMATION APPARATUS

(75) Inventor: Ichiro Yokozeki, Yokosuka (JP)

(73) Assignee: Harison Toshiba Lighting Corp. (JP)

( * ) Notice: Subject to any disclaimer, the term of this patent is extended or adjusted under 35 U.S.C. 154(b) by 0 days.

(21) Appl. No.: 10/186,527

(22) Filed: Jun. 28, 2002

(65) Prior Publication Data

US 2003/0000943 A1 Jan. 2, 2003

(30) Foreign Application Priority Data

Jun. 28, 2001 (JP) ..... 2001-196849

(51) Int. Cl.[7] ..... H05B 6/08; H05B 6/14; G03G 15/20

(52) U.S. Cl. ..... 219/619; 219/656; 219/662; 219/666; 399/328; 399/330

(58) Field of Search ..... 219/619, 655, 219/656, 661, 662, 663, 666, 671; 399/328, 330, 331, 335, 336

(56) References Cited

U.S. PATENT DOCUMENTS 4,506,131 A * 3/1985 Boehm et al. ..... 219/662
4,675,487 A * 6/1987 Verkasalo ..... 219/619
6,316,754 B1 * 11/2001 Schatz et al. ..... 219/656

FOREIGN PATENT DOCUMENTS

| | | |
|---|---|---|
| JP | 59-33787 | 2/1984 |
| JP | 2000-215971 | 8/2000 |
| JP | 2000-215974 | 8/2000 |
| JP | 1001-016335 | 8/2002 |

* cited by examiner

*Primary Examiner*—Philip H. Leung
(74) *Attorney, Agent, or Firm*—Jenkens & Gilchrist, P.C.

(57) ABSTRACT

An induction heating roller apparatus that varies temperature distribution in the axial direction of a heating roller. The apparatus includes a heating roller and a plurality of induction coils arranged separately along an axial direction of the heating roller. The heating roller includes a secondary coil that is air-core transfer coupled to the induction coils. The apparatus further includes a plurality of capacitors, each being connected to one of the induction coils to form a resonance circuit. At least one of the resonance circuits has a resonance point that differs from the remaining resonance circuits.

21 Claims, 9 Drawing Sheets

INDUCTION HEATING ROLLER APPARATUS OF IMAGE FORMATION APPARATUS

BACKGROUND OF THE INVENTION

The present invention relates to an induction heating roller apparatus and to a fixing apparatus and an image formation apparatus, which are provided with the fixing apparatus.

Heating rollers, which employ halogen lamps as heat sources, are used in the prior art to thermally fix a toner image. However, the halogen lamp heat sources are inefficient and require a large amount of power. Accordingly, a technique involving induction heating is being developed to solve such problems.

Japanese Laid-Open Patent Publication No. 2000-215974 describes an exciting coil, which is arranged near a heated object. The exciting coil generates an induction current in the heated object, which is a magnetic heating roller. The exciting coil is formed by winding a coil in a planar manner along a curved surface of the heated object. A magnetic core is arranged along the curved surface of the exciting coil on the side opposite to the heated object at the longitudinal ends of the exciting coil (first prior art example).

Japanese Laid-Open Patent Publication No. 2000-215971 describes an induction heating apparatus having a heating rotor, or heating roller, which generates heat by means of electromagnetic induction, and a magnetic flux generating means, which is arranged in the heating rotor. The magnetic flux generating means includes a magnetic core and an electromagnetic conversion coil, which is wound about the core. The magnetic core includes a core portion, about which the electromagnetic conversion coil is wound, and a magnetic flux induction core portion. The magnetic flux induction core portion, which has a magnetic gap between its distal ends, concentrates magnetic flux at part of a heating rotor rather than the core portion (second prior art example).

The first and second prior art examples employ a heating technique that uses eddy current loss (hereafter referred to as eddy current loss technique). Such heating technique works under the same principle as that applied to IH jars. The frequencies of the high frequency employed in the eddy current loss technique is about 20 to 100 kHz.

In comparison, Japanese Laid-Open Patent Publication No. 59-33787 describes a high frequency induction heating roller. The high frequency induction heating roller includes a cylindrical roller body, or heating roller, which is formed by a conductive member, a cylindrical bobbin, which is arranged in the roller body in concentricity with the roller body, and an induction coil, which is spirally wound about the periphery of the bobbin. When current flows through induction coil, the induction coil, which induces induction current in the roller body, is heated (third prior art example).

In the third prior art example, the cylindrical roller body functions as a secondary coil, which is a closed circuit, and the induction coil functions as a primary coil. This causes transformer coupling between the primary and secondary coils and induces a secondary voltage in the secondary coil of the cylindrical roller body. Based on the secondary voltage, a secondary current flows in the closed circuit of the secondary coil. This is a heating technique (hereafter referred to as a transformer technique) that heats a secondary resistor, which heats the cylindrical roller body. The transformer technique, which has a high stationary efficiency since its magnetic coupling is stronger than the eddy current loss technique, entirely heats the heating roller. Thus, the transformer technique is advantageous in that is simplifies the structure of a fixing apparatus in comparison to the first and second prior art examples. Further, when the operational frequency is 100 kHz or greater, and preferably a high frequency of 1 MHz or greater, the Q of the induction coil may be increased to increase the power transmission efficiency. This increases the total heating efficiency and reduces power consumption. Further, the heat capacity is much smaller than that of the eddy current loss technique. Accordingly, the transformer technique is preferable for increasing the speed of thermal fixing.

The inventors have invented a transformer coupling technique that efficiently heats the heating roller. In the transformer coupling technique, by forming a closed circuit, the secondary reactance of which is substantially equal to a secondary resistance of the heating roller that is air-core transformer coupled to an induction coil, the efficiency for transmitting power from the induction coil to the heating roller increases. This efficiently heats the heating roller. An application for a patent for this invention was applied for in Japanese Patent Application No. 2001-016335. The invention reduces power consumption for induction heating of the heating roller and facilitates increasing the speed of thermal fixing.

In an image formation means, such as a copy machine or a printer, paper on which images are formed is selected from multiple sizes. To cope with such function, the heating area of the heating roller must be changed in accordance with the paper size.

SUMMARY OF THE INVENTION

It is an object of the present invention to provide an induction heating roller apparatus that varies temperature distribution in the axial direction of a heating roller and to provide a fixing apparatus and an image formation apparatus, which employ such induction heating roller apparatus.

It is a further object of the present invention to provide an induction heating roller apparatus that varies the temperature distribution in the longitudinal direction of the heating roller in the transformer technique and to provide a fixing apparatus and an image formation apparatus provided with such induction heating roller apparatus.

To achieve the above objects, the present invention provides an induction heating roller apparatus includes a heating roller and a plurality of induction coils arranged separately along an axial direction of the heating roller. The heating roller includes a secondary coil that is air-core transfer coupled to the induction coils. The induction heating roller apparatus further includes a plurality of capacitors, each being connected to one of the induction coils to form a resonance circuit. At least one of the resonance circuits has a resonance point that differs from the remaining resonance circuits.

The terms used to describe the present invention are defined below.

[Heating Roller]

The heating roller includes a secondary coil, which forms a closed circuit. The secondary coil is air-core transformer coupled to a primary core. It is preferred that a secondary side resistance value of the closed circuit have a value that is substantially equal to a secondary reactance of the secondary coil. The secondary side resistance and the secondary reactance being "substantially equal" refers to a range that satisfies equation 1 when the secondary side resistance is represented by Ra, the secondary reactance is represented by Xa, and $\alpha$=Ra/Xa. Further, the secondary side resistance may be obtained through measurements. The secondary side reactance may be obtained through calculations.

$$25<\alpha<4 \quad \text{equation 1}$$

The heating roller may include one or more than one secondary coil. When there is only one secondary coil, it is preferred that the secondary coil be extended along the entire effective length of the heating roller in the axial direction. Further, when there is more than one secondary coil, it is preferred that the secondary coils be arranged in the axial direction separated from one another.

Further, the secondary coil may be formed from a conductive body, such as a conductive layer, a conductive wire, or a conductive plate. To obtain the required secondary side resistance, the conductive layer may be made from the following material in the following manner. When forming the conductive layer though a thick film formation technique (application and sintering), it is preferred that the material be selected from a group consisting of Ag, Ag+Pd, Au, Pt, $RuO_2$, and C. To apply the material, a screen printing technique, a roll coater technique, or a spraying technique may be employed. In comparison, when forming the conductive layer through vapor deposition or sputtering, it is preferred that the conductive layer be made of a material selected from a group consisting of Au, Ag, Ni, and Cu+(Au, Ag). It is preferred that that copper and aluminum be used to form the conductive wire and the conductive plate.

To obtain a further virtual heating roller, it is preferred that the following elements be added.

1. Roller Base

A roller base, which is made of an insulative material, may be used to support the secondary coil. In this case, the secondary coil may be arranged on the outer surface, the inner surface, or in the interior of the roller body. The insulative roller body may be formed from ceramic or glass. Taking into consideration, the heat resistant characteristic, the impact resistant characteristic, and the mechanical strength of the roller body, the following materials may be used. For example, the ceramic may be alumina, mullite, aluminum nitride, or silicon nitride. For example, the glass may be crystallized glass, quartz glass, or Pyrex.

2. Heat Diffusion Layer

A heat diffusion layer, which is used as a means for improving the uniformity of temperature in the axial direction of the heating roller, may be arranged on the upper side of the conductive layer when necessary. Thus, it is preferred that a substance exhibiting satisfactory thermal conduction in the axial direction of the heating roller be used. Metals having high electric conductivity, such as Cu, al, Au, Ag, and Pt, often include substances having high thermal conduction. It is required that the heat diffusion layer have thermal conduction that is equal to or greater than that of the material of the conductive layer. Accordingly, the heat diffusion layer may be formed from the same material as the conductive layer.

Further, when the heat diffusion layer is formed from a conductive substance, the heat diffusion layer may conductively contact the conductive layer. However, by arranging the heat diffusion layer on an insulating film, noise would be shut out. Since a high frequency magnetic field does not reach the heat diffusion layer, a secondary current that contributes to heating is not induced in the heat diffusion layer.

3. Protection Layer

A protection layer is employed when necessary to mechanically protect and electrically insulate the heating roller or to improve the elastic contact characteristic or toner separation characteristic of the heating roller. Glass may be used as the material of a protection layer employed to mechanically protect and electrically insulate the heating roller. Synthetic resin may be used as the material of a protection layer employed to improve the elastic contact characteristic or toner separation characteristic of the heating roller. The material of the glass may be selected from a group consisting of zinc borosilicate glass, lead borosilicate glass, borosilicate glass, and aluminosilicate glass. The material of the synthetic resin may be selected from a group consisting of silicone resin, fluororesin, polyimide resin+fluororesin, and polyamide+fluororesin. When polyimide+fluororesin or polyamide+fluororesin are employed, fluororesin is arranged on the outer side.

4. Shape of Heating Roller

A crown may be formed on the heating roller if desired. The crown may be drum-like or barrel-like.

5. Rotating Mechanism of Heating Roller

A known mechanism may be employed as the mechanism for rotating the heating roller.

[Induction Coils]

The induction coils, which are arranged separately from one another in the axial direction of the heating roller, are excited by a high frequency power supply. Further, the induction coils function to produce a high frequency AC magnetic field in the heating roller and function to transfer high frequency power to the secondary coil. Each induction coil is inserted in the interior of the hollow heating roller and configured to function as a primary coil of a transformer and performs air-core transformer coupling with the secondary coil of the heating roller. The induction coils may be stationary relative to the rotated heating roller, integrally rotated with the heating roller, or rotated separately from the heating roller. When the induction coils are rotated, a rotary collector mechanism may be arranged between the high frequency power supply and the induction coils. The term "air-core transformer coupling" refers to not only transformer coupling of a complete air-core but also to transformer coupling of a substantial air-core. For example, such a case would be when a magnetic body is not included in the interior of the induction coils.

The induction coils may use a coil bobbin, which is formed from a material having the smallest possible induction loss to maintain the induction coil in a predetermined form or at a predetermined position. The coil bobbin may have a winding groove used to wind the coils properly or an axial groove used to retain a lead wire. Instead of using the coil bobbin, the induction coils may be configured to maintain a predetermined form by forming the induction coils from synthetic resin or glass or by using synthetic resin or glass as an adhesive.

Further, the induction coils may be connected in series or in parallel to a common high frequency power supply by a lead wire. If necessary, the induction coils may be connected to different high frequency power supplies. In any case, it is preferred that the lead wire, which sends a high frequency to the induction coils from a high frequency power supply and which may also be connected to a capacitor, be arranged at a position that is close to the inner or outer surface of the induction coils. When the lead wire extends into the interior of the induction coils, the magnetic flux that interlinks the lead wire increases if the lead wire is near the axis of the induction coils. This produces eddy current loss in the interior of the induction coils and decreases power transmission efficiency. Such state is not desirable. In comparison, the above structure decreases the magnetic flux that interlinks the lead wire. This suppresses a relative decrease in the power transmission efficiency.

[Capacitors]

A plurality of capacitors are connected to the induction coils and form resonance circuits with the induction coils, respectively. The resonance points of the resonance circuits are not uniform. The term "resonance points are not uniform" refers to a state in which all of the resonance circuits, each formed by the set of each induction coil and the associated capacitor, do not have the same resonance point. For example, when there are two induction coils, the associated resonance circuits have different resonance points. When there are three induction coils, one of the resonance circuits, which is formed by at least one of the induction coils and the corresponding capacitors, has a resonance point that differs from the resonance points of the remaining two resonance circuits. Some of the resonance circuits may have the same resonance points.

The locations of the capacitors are not restricted. The capacitors may be arranged near the induction coils in the heating roller depending on the heat resistant temperature and the space in the heating roller. Alternatively, the capacitors may be separated from the induction coils and the heating roller.

[Other Elements]

Although the following elements are not requisite elements of the present invention, the following elements may be selected to obtain a further effective induction heating roller apparatus.

1. High Frequency Power Supply

It is preferred that a high frequency power supply be configured so that it outputs a high frequency of 100 KHz or higher. However, the frequency of the output of the high frequency power supply is basically not restricted. When using a high frequency of 100 kHz or more, the Q of the induction coil may be increased by further increasing the power transmission efficiency. When the power transmission efficiency increases, the total heating efficiency increases and power consumption is reduced. The preferred frequency is 1 to 4 MHz from the viewpoint of the economy of the suitable active devices (e.g., MOSFET) and the simplicity for suppressing noise.

To generate a high frequency, the direct or indirect conversion of a DC or low frequency AC to a high frequency with an active device, such as a semiconductor switch device, is realistic. To obtain high frequency power from low frequency AC, a rectifying means may be used to temporarily convert the low frequency AC to DC. The DC may be a smoothened DC formed by a smoothing circuit or a non-smoothened DC. To convert DC into a high frequency, circuit devices, such as an amplifier and an inverter, may be used. An E-grade amplifier, which has high power conversion efficiency, may be used as the amplifier. A half-bridge inverter may also be used. Further, the optimal active device is a MOSFET, which has a superior high frequency characteristic. A plurality of parallel-connected high frequency power supply circuits may be configured to synthesize the high frequency output of each high frequency power supply circuit before applying the high frequency output to the induction coils. This allows the output of each high frequency power supply circuit to be small and to use the MOSFET as the active device while obtaining the required power. This inexpensively and efficiently generates the high frequency.

When the frequency of the high frequency power supply is variable, the power supplied to each induction coil may be separately controlled. Further, when necessary, when the apparatus is activated, the power supplied to the apparatus may be greater than that during normal operation to quickly heat the rollers.

Further, the high frequency power supply may be shared by the plurality of induction coils. However, if necessary, a high frequency power supply, which frequency is variable, may be provided for each induction coil.

2. Warm-Up Control

When the operation of the apparatus is started, or when the apparatus is being warmed up after the supply of power starts, the heating roller is controlled so that it rotates at a speed lower than during normal operation.

3. Temperature Control of Hating Roller

To maintain the temperature of the heating roller within a predetermined range at a constant value, for example 200° C., the surface of the heating roller is in contact with a heat sensitive device in a thermally conductive manner. A thermistor having a negative temperature characteristic or a non-linear resistor having a positive temperature characteristic may be used as the heat sensitive device.

4. Transfer Sheet

When using the heating roller to heat a heated object, the heating roller may be directly pressed against the heated object. However, if necessary, a transfer sheet may be arranged between the heating roller and the heated object. In this case, the transfer sheet may be endless or roll-like. By using the transfer sheet, the heating and transferring of the heated object are performed smoothly.

[Operation of the Present Invention]

When a high frequency voltage is applied to the induction coils, the induction coils generate a high frequency magnetic field that interlinks the secondary coil of the heating roller. That is, the induction coils function as primary coils, and air-core transformer coupling is performed between the induction coils and the secondary coil. As a result, the secondary coil forms a closed circuit. Thus, a secondary current flows in the circumferential direction of the heating roller. Since the secondary coil has an appropriate secondary side resistance, the secondary coil generates joule heat with the secondary current and the temperature of the heating roller increases. Further, if transformer coupling is performed at a high frequency of 100 kHz or greater, the air-core transformer coupling increases the power transmission efficiency to, for example, 95% or greater. Thus, power consumption is reduced.

In the present invention, by forming resonance circuits with sets of the induction coil and the capacitor and having non-uniform resonance points, the following effects are obtained. The high frequency power generated by the induction coils fluctuates in accordance with the terminal voltage of the induction coils. In a resonance circuit formed by an induction coil and a corresponding capacitor, the voltage applied to the induction coil changes in accordance with the position in a resonance characteristic curve of the resonance circuit at which the resonance circuit operates. For example, the voltages at the ends of the induction coil changes in accordance with the level of resonance, and the terminal voltage increases at locations closer to the resonance point. The resonance characteristic becomes more significant as the Q of the resonance circuit increases. Accordingly, when the resonance circuits, which are formed by the induction coils and the corresponding capacitors, have different resonance points and the same high frequency voltage of a certain frequency is applied to each resonance circuit, the power supplied to the induction coil at an operational position on the resonance characteristic curve of each resonance circuit that is closer to the resonance point is greater than that supplied to an operational point that is farther from the resonance point. When the resonance points differ, a difference in the power supplied to each induction coil is produced. Further, when the frequency of the high frequency changes, the operational position on the resonance characteristic curve changes. Thus, the supplied power changes in a different manner between different induction coils. Further, the induction coils are dispersed in the axial direction of the heating roller, as described above. Thus, the distribution of the heat amount produced in the axial direction of the heating roller by transformer coupling is not uniform.

Accordingly, priority for the temperature increase of the heating roller is given to areas corresponding to the paper size. By selecting a frequency that equalizes the terminal voltage of each induction coil, each induction coil is heated at substantially the same temperature. This enables heating in correspondence with a large paper size.

The present invention specifies the optimal position of each capacitor, which forms the resonance circuit with the corresponding induction coil. In other words, the capacitors are arranged at the outer side of the heating coil, which is relatively separated from the induction coils. The capacitors may be arranged anywhere as long as they are located at the outer side of the heating roller. The induction coils, which are located inside the heating roller, and the capacitors, which are located outside the heating roller, may be connected by a lead wire.

Further, the capacitors may be mounted on the same circuit substrate. Alternatively, the capacitors may be arranged separated from each other without using a circuit substrate.

Such structure has the advantages described below.

1. The ambient temperature of the capacitors is lower than the interior of the heating roller. Thus, capacitors that have a low heat resistant grade and are inexpensive may be used. This contributes to the reduction in the cost of the heating roller apparatus.

2. The diameter of the heating roller may be reduced. The capacitors reduce the number of components arranged in the heating roller. This enables the diameter of the heating roller to be decreased. Thus, the present invention contributes to the manufacturing of a more compact heating roller apparatus.

The present invention specifies the optimal structure for changing the frequency of the high frequency that is applied to the induction coils and enables the heating area of the heating roller to be variable. In other words, the output frequency of the high frequency power supply is variable. Further, the induction coils share the same induction coils. To change the frequency, the exciting frequency of the high frequency power supply may be changed. To change the frequency, an external signal is provided to the high frequency power supply. When the external signal is a digital signal, an excitation oscillator of the high frequency power supply may be controlled by an A/D converter.

In the present invention, by using the same high frequency power supply, the power supplied to at least some of the induction coils may be controlled separately without switching high frequency output circuits. This enables control of the heating area in the axial direction of the heating roller. Thus, when using the heating roller of the present invention in a fixing apparatus, the temperature of areas in the axial direction, which correspond to the paper size, may be selectively increased.

The heating areas are controlled without switching electric circuits. This simplifies the circuit configuration and enables the induction heating apparatus to be inexpensive.

Further, the same high frequency power supply is used for a plurality of the induction coils. This saves costs related with the high frequency power supply.

A further perspective of the present invention is a fixing apparatus including a pressing roller, and an induction heating roller apparatus including a heating roller pressed by the pressing roller. The induction heating roller apparatus holds a recording medium, on which a toner image is formed, between the pressing roller and the heating roller to transfer the recording medium and fix the toner image on the recording medium. The induction heating roller includes a plurality of induction coils arranged separately along an axial direction of the heating roller. The heating roller includes a secondary coil that is air-core transfer coupled to the induction coils. The induction heating roller further includes a plurality of capacitors, each being connected to one of the induction coils to form a resonance circuit. At least one of the resonance circuits has a resonance point that differs from the remaining resonance circuits.

A pressing roller and a heating roller may be directly pressed against each other. However, if necessary, a transfer sheet may be arranged in between the pressing roller and the hating roller so that they are indirectly pressed against each other. The transfer sheet may be endless or roll-like.

In the present invention, a toner image is fixed at a high speed while a recording medium, on which the toner image is formed, is transferred in a state held between the pressing roller and the heating roller.

A further perspective of the present invention is an image formation apparatus including an image formation unit for forming a toner image on a recording medium, and a fixing apparatus for transferring a recording medium, on which a toner image is formed, and fixing the toner image on the recording medium. The fixing apparatus includes an induction heating roller apparatus having a pressing roller and a heating roller pressed by the pressing roller. The induction heating roller apparatus holds a recording medium, on which the toner image is formed, between the pressing roller and the heating roller to transfer the recording medium and fix the toner image on the recording medium. The induction heating roller apparatus has a plurality of induction coils arranged separately along an axial direction of the heating roller. The heating roller includes a secondary coil that is air-core transfer coupled to the induction coils. The heating roller further includes a plurality of capacitors, each being connected to one of the induction coils to form a resonance circuit. At least one of the resonance circuits has a resonance point that differs from the remaining resonance circuits.

In the present invention, the image formation unit forms an image that forms image information on the recording medium through an indirect technique or a direct technique. The term "indirect technique" refers to a technique for forming an image through transcription.

The image formation apparatus corresponds to, for example, an electronic photograph copying machine, a printer, or a facsimile.

The recording medium corresponds to, for example, a transcription material sheet, a printing paper, an electronic facsimile sheet, or an electrostatic recording sheet.

The present invention enables the employment of an image formation apparatus that is optimal for high speeds.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment according to the present invention will now be discussed with reference to the drawings.

Figure 1:
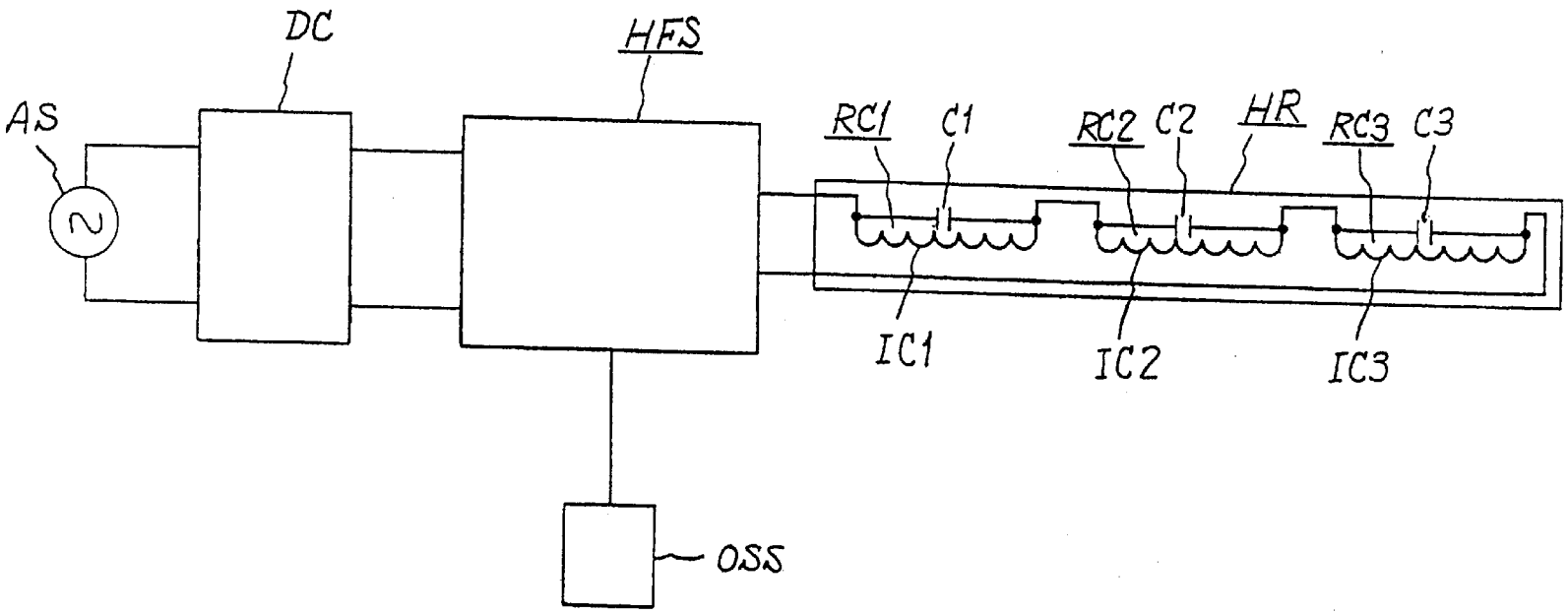
FIG. 1 is a schematic circuit block diagram showing an induction heating roller apparatus according to a first embodiment of the present invention.

FIG. 1 is a schematic circuit block diagram showing an induction heating roller apparatus according to a first embodiment of the present invention.

Figure 2:
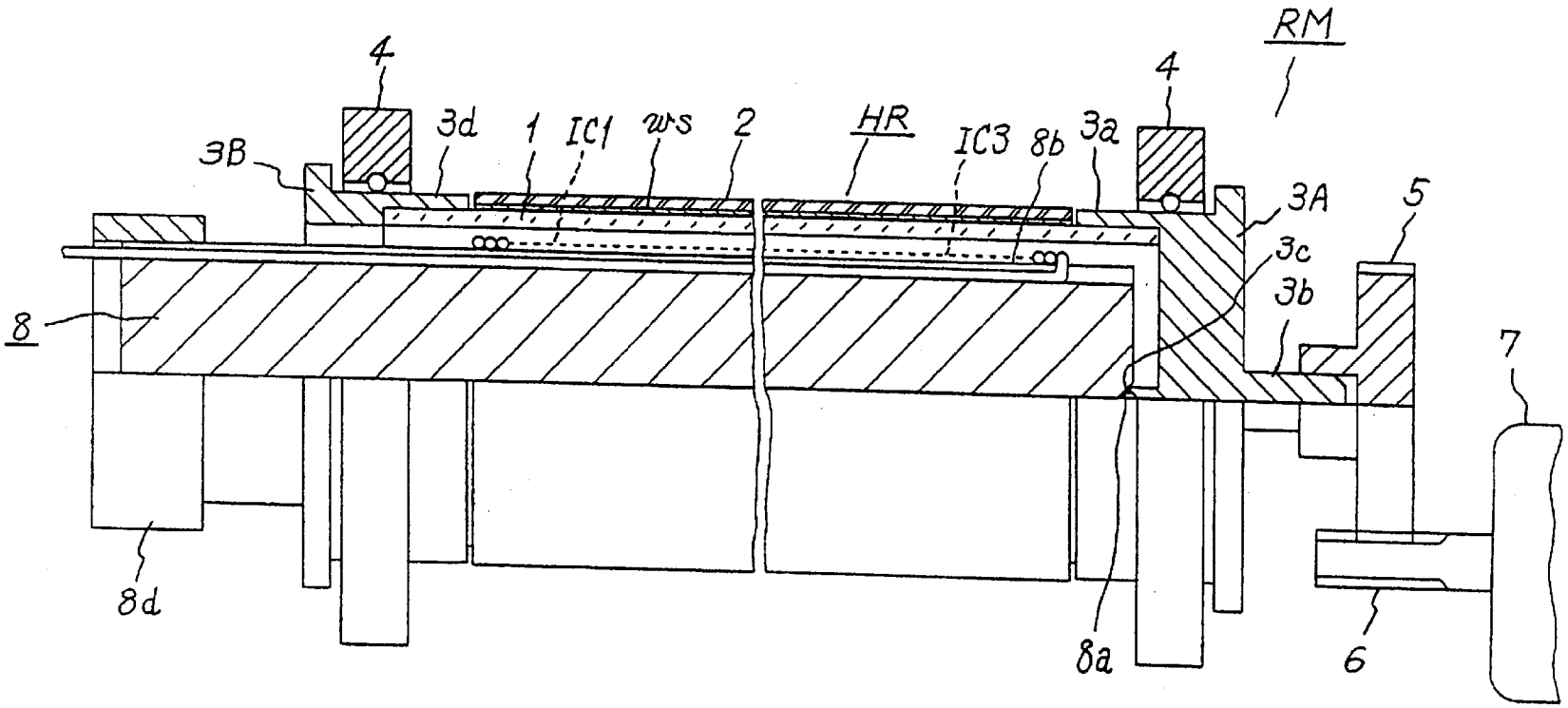
FIG. 2 is a partially cutaway front cross-sectional view of an induction coil an a heating roller.

FIG. 2 is a partially cutaway front cross-sectional view of an induction coil and a heating roller.

Figure 3:
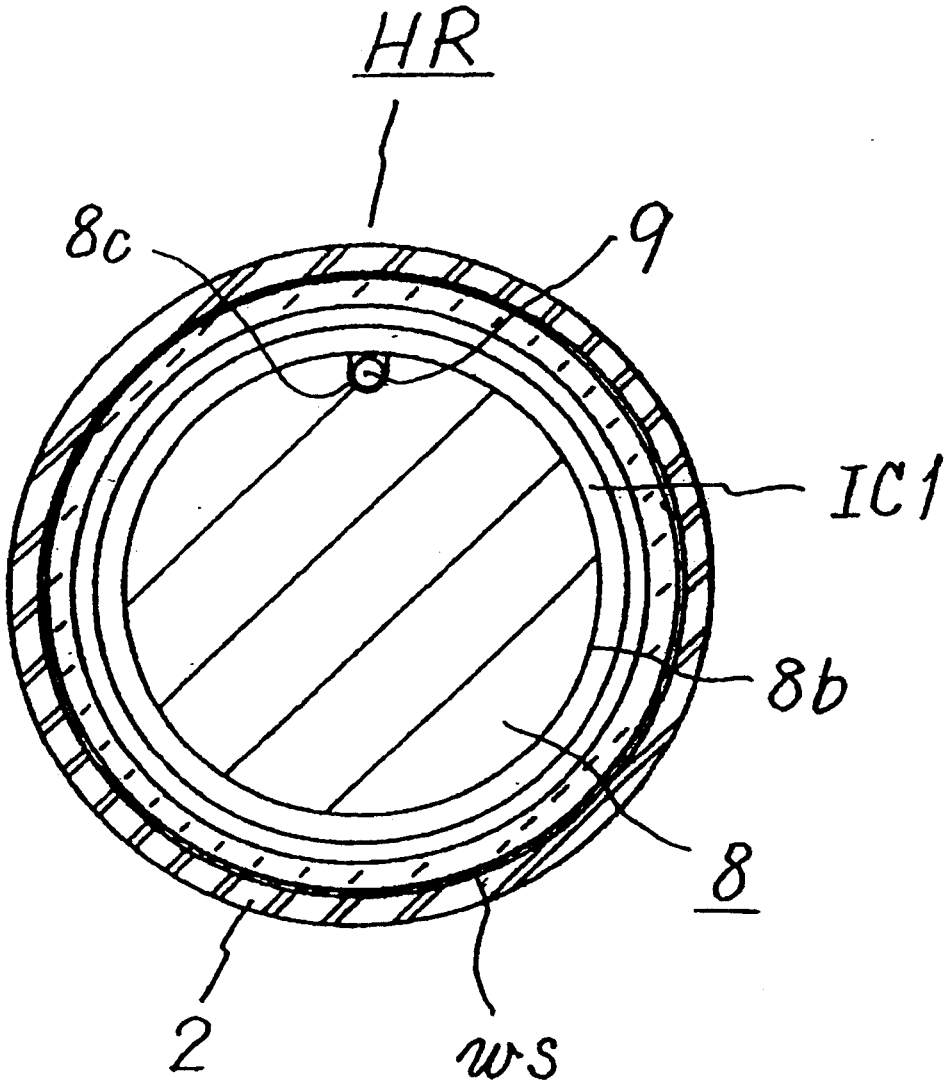
FIG. 3 is a side cross-sectional view of the induction coil and the heating roller.

FIG. 3 is a side cross-sectional view of the induction coil and the heating roller.

Figure 4:
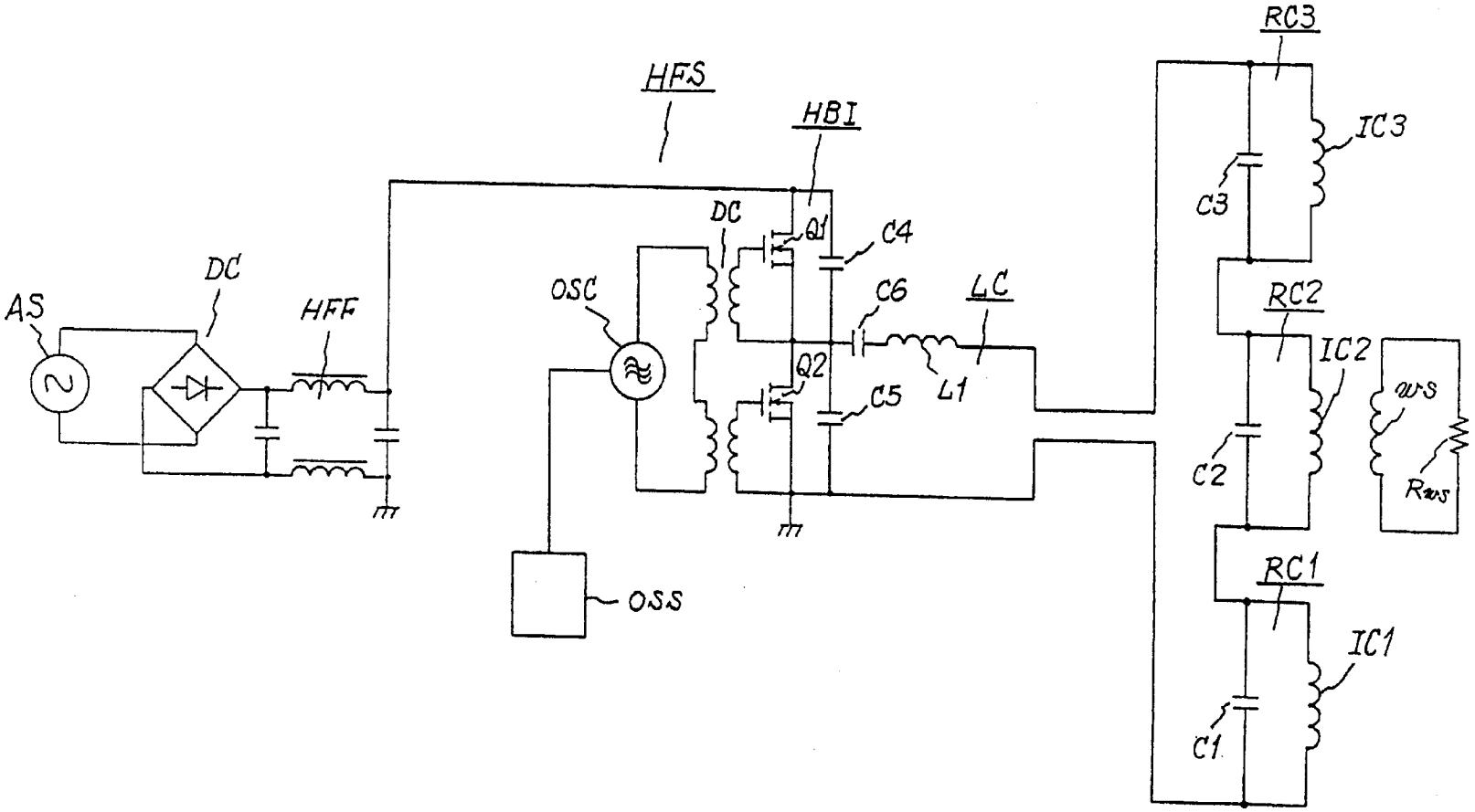
FIG. 4 is a circuit diagram of an electric circuit.

FIG. 4 is a circuit diagram of an electric circuit.

Figure 5:
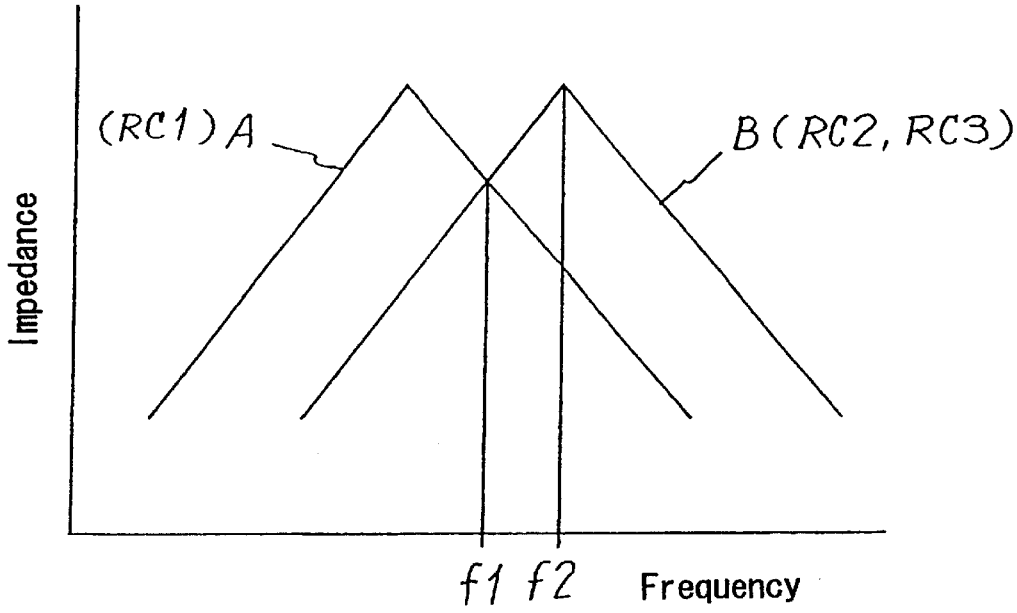
FIG. 5 is a graph schematically illustrating the resonance characteristics of three resonance circuits.

FIG. 5 is a graph schematically illustrating the resonance characteristics of three resonance circuits. In the graph, the horizontal axis represents frequency and the vertical axis represents the absolute value of impedance.

The induction heating roller apparatus includes a heating roller HR, three induction coils IC1, IC2, IC3, and three capacitors C1, C2, C3. The heating roller HR incorporates a rotating mechanism RM, which is shown in FIG. 2. The rotating mechanism RM drives and rotates the heating roller HR. The three induction coils IC1, IC2, IC3 and the three capacitors C1, C2, C3 form three resonance circuits RC1, RC2, RC3, respectively. The resonance circuits RC1, RC2, RC3 are biased by a high frequency power source HFS. The high frequency power source HFS supplies the induction coils IC1, IC2, IC3 with high frequency power. The high frequency power source has an input terminal, which is connected to an output terminal of a DC current source DC. The DC current source DC has an input terminal, which is connected to a low frequency AC power source AS. The structure of each device will now be discussed in detail.

[Heating Roller HR]

The heating roller HR, which is driven by the rotating mechanism RM, includes a roller base 1, a secondary coil ws, and a protection layer 2.

The roller base 1, which is a hollow cylindrical body and made of alumina ceramic, has, for example, a length of 300 mm and a thickness of 3 mm.

The secondary coil ws is a CU vapor deposition film, which is formed from a film-like cylindrical single-turn coil, and arranged along the entire effective length in the axial direction on the outer surface of the roller base 1. The thickness of the secondary coil ws is set so that a secondary side resistance in the circumferential direction of the heating roller HR is 1Ω, the value of which is substantially the same as that of a secondary reactance.

The protection layer 2 is made of fluororesin and formed by coating the outer surface of the secondary coil ws.

The rotating mechanism RM is a mechanism for rotating the heating roller HR. As shown in FIGS. 2 and 3, the rotating mechanism RM includes a first end member 3A, a second end member 3B, two bearings 4, a bevel gear 5, a spline gear 6, and a motor 7.

The first end member 3A includes a cap 3*a*, a drive shaft 3*b*, and an inner end 3*c*. The left end of the cap 3*a*, as viewed in FIG. 2, is fitted on the heating roller HR and fixed to the heating roller HR by a bolt (not shown). The drive shaft 3*b* extends outward from the outer central portion of the cap 3*a*. The inner end 3*c* extends inward from the inner central portion of the cap 3*a*.

The second end member 3B includes a ring 3*d*. The right end of the ring is fitted on the heating roller HR by a bolt (not shown).

One of the two bearings 4 rotatably support the outer surface of the cap 3*a* of the first end member 3A. The other one of the two bearings 4 rotatably support the outer surface of the second end member 3B. Accordingly, the heating roller HR is rotatably supported by the first and second end members 3A, 3B, which are connected to the ends of the heating roller HR, and the pair of bearings 4.

The bevel gear 5 is attached to the drive shaft 3*b* of the first end member 3A. The spline gear 6 is meshed with the bevel gear 5. The motor 7 has a rotor shaft, which is directly connected to the spline gear 6.

[Three Induction Cols IC1, IC2, IC3]

The three induction coils IC1, IC2, IC3 are magnetically coupled to the secondary coil ws of the heating roller HR. As shown in FIGS. 2 and 3, the induction coils IC1, IC2, IC3 are wound about a coil bobbin 8 and arranged separately from one another in the axial direction of the heating roller HR. Further, the induction coils IC1, IC2, IC3 are connected in series between two lead wires 9. The lead wires 9 connect the induction coils IC1, IC2, IC3 to the output terminal of the high frequency power source HFS.

The coil bobbin 8, which is a solid cylindrical body made of fluororesin, has a recess 8*a*, a support portion 8*b*, and a groove 8*c*. The recess 8*a* is formed in the center of the distal end of the coil bobbin 8 and is engaged with the rotating mechanism RM in a relatively rotatable manner. The support portion 8*b* is formed on the basal end of the coil bobbin 8 and fixed to a fastening portion (not shown). The groove 8*c* is formed in a cask-like manner in part of the outer surface of the coil bobbin 8 in the axial direction to accommodate the lead wire 9. As shown in FIG. 3, the lead wires 9 are accommodated in the groove 1*c*, extended out of the basal end of the coil bobbin 8, and connected to the output terminal of the high frequency power supply HFS by a coaxial cable.

The three induction coils IC1, IC2, IC3 are used in a stationary state, and the lead wires I are accommodated in the groove 1*c* near the induction coils IC1, IC2, IC3. Thus, interlinking of a magnetic flux hardly occurs. Thus, almost no eddy current loss occurs in the lead wires.

The three induction coils IC1, IC2, IC3 are inserted in the hearing roller HR from the ring 3*d* of the second end member 3B. The recess 1*a* formed in the distal end of the coil bobbin 8 is engaged with the inner end of the first end member 3A. The support portion 8*b*, which is formed in the basal end, is fixed to the fastening portion. Accordingly, the three induction coils IC1, IC2, IC3 are supported coaxially with the heating roller HR and maintained in a stationary state even if the heating roller HR is rotated.

[Three Capacitors C1, C2, C3]

The three capacitors C1, C2, C3 are parallel-connected to the three induction coils IC1, IC2, IC3 as shown in FIGS. 1 and 4 to form three resonance circuits RC1, RC2, RC3. In FIGS. 4 and 5, $R_{ws}$, denotes an equivalent resistor of a closed circuit formed by a secondary coil ws of the heating roller HR.

[Three Resonance Circuits RC1, RC2, RC3]

Referring to FIG. 5, among the three resonance circuits RC1, RC2, RC3, the resonance circuits RC1, RC2 have resonance points indicated by curve A, and the resonance circuit RC3 has resonance points indicated by curve B. That is, the resonance points of curve A is offset from the resonance points of curve B.

[High Frequency Power Supply HFS]

Referring to FIG. 4, the high frequency power supply HFS includes a high frequency filter HFF, a high frequency oscillator OSC, which frequency is variable, a drive circuit DC, a half-bridge inverter main circuit HBI, a load circuit LC, and an external signal source OSS.

The high frequency filter HFF is arranged between the DC power source DC and the half-bridge inverter main circuit HBI and prevents high frequencies from entering the low frequency AC power source AS.

The high frequency oscillator OSC varies the oscillation frequency to generate a high frequency signal having a predetermined frequency and sends the high frequency signal to the drive circuit DC.

The drive circuit DC, which is a preamplifier, amplifies the high frequency signal sent from the high frequency oscillator OSC to output the drive signal.

The half-bridge inverter main circuit HBI includes two MOSFETs Q1, Q2, which are connected in series between the output terminals of the DC power supply DC, and two capacitors C4, C5, which are connected parallel to the MOSFETs Q1, Q2. The MOSFETs Q1, Q2 are alternately switched by drive signals of a drive circuit DC. The half-main bridge inverter main circuit HBI converts the DC output of the DC power supply DC to a high frequency having a substantially rectangular wave. The capacitors C4, C5 function as a high frequency bypass when inverting is being performed.

The load circuit LC includes a DC cut capacitor C6, an inductor L1, and the three capacitors C1, C2, C3. The DC cut capacitor C6 prevents a DC component from flowing to the load circuit LC from the DC power supply DC side via the MOSFETs Q1, Q2. The inductor L1 and the three capacitors C1, C2, C3 form a series resonance circuit and waveform shape the high frequency voltage applied to the ends of the three induction coils IC1, IC2, IC3. The waveform shaped high frequency voltage biases the three induction coils IC1, IC2, IC3.

The external signal source OSS varies the output frequency of the high frequency power supply HFS and controls the oscillator OSC to vary the oscillation frequency of the oscillator OSC.

[DC Power Source DC]

The DC power source DC is a rectifying circuit and has an input terminal, which is connected to the low frequency SC power source AS. The DC power source DC coverts the low frequency AC voltage to a non-smoothened DC voltage, which is output from the DC output terminal of the DC power source DC.

[Low Frequency AC Power Source AS]

The low frequency AC power source is formed by, for example, a 100V commercial AC power source.

[Operation of the Induction Heating Roller Apparatus]

The low frequency AC voltage of the low frequency AC power source AS is converted to a DC voltage of the DC power source DC, which is further converted to a high frequency voltage by the high frequency power source HFS. The high frequency voltage is applied to the three induction coils IC1, IC2, IC3.

The resonance characteristic of the resonance circuit RC1, which is formed by the induction coil IC1 and the capacitor C1, is set beforehand in accordance with curve A of FIG. 5. In comparison, the resonance characteristic of the resonance circuits RC2 and RC3, which are formed by the induction coil IC2, IC3 and the capacitors C2, C3, is set beforehand in accordance with curve B of FIG. 5. Accordingly, the two resonance characteristics differ from one another. Thus, since the absolute values of the impedance of the induction coils IC1, IC2, IC3 are substantially equal when the frequency is f1, values of the heat amount generated by applying a high frequency voltage to the induction coils IC1, IC2, IC3 are substantially equalized. As a result, the temperature of the heating roller HR is uniform substantially along the entire effective length as shown by curve C in FIG. 6.

Figure 6:
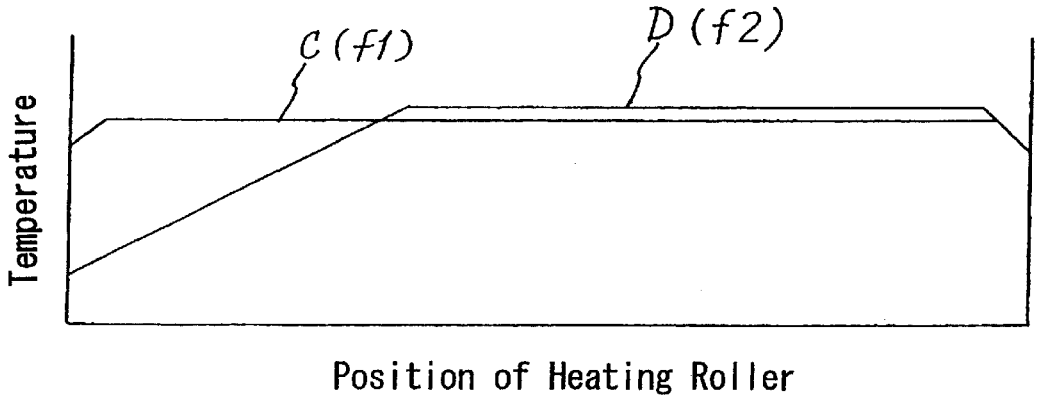
FIG. 6 is a graph illustrating the temperature distribution in the axial direction of the heating roller when the frequency is f1 and f2 in the heating roller apparatus according to the first embodiment of the present invention.

FIG. 6 is a graph illustrating the temperature distribution in the axial direction of the heating roller in the heating roller apparatus according to the first embodiment of the present invention when the frequency is f1 and f2. In the graph, the horizontal axis represents the position of the heating roller (in the axial direction), and the vertical axis represents the temperature.

When the external signal source OSS controls the high frequency power source HFS to change the frequency of the output to f2, the resonance circuits RC2 and RC3 are biased at the resonance points of the resonance characteristics. However, since the resonance circuit RC1 significantly differs from the resonance point, the terminal voltage of the resonance circuits RC2, RC3 increases and the terminal voltage of the resonance circuit RC1 decreases. As a result, the temperature distribution of the heating roller HR is such that the central and right areas, as viewed in the drawing, are high and the left area is low, as shown by curve D of FIG. 6.

Figure 7:
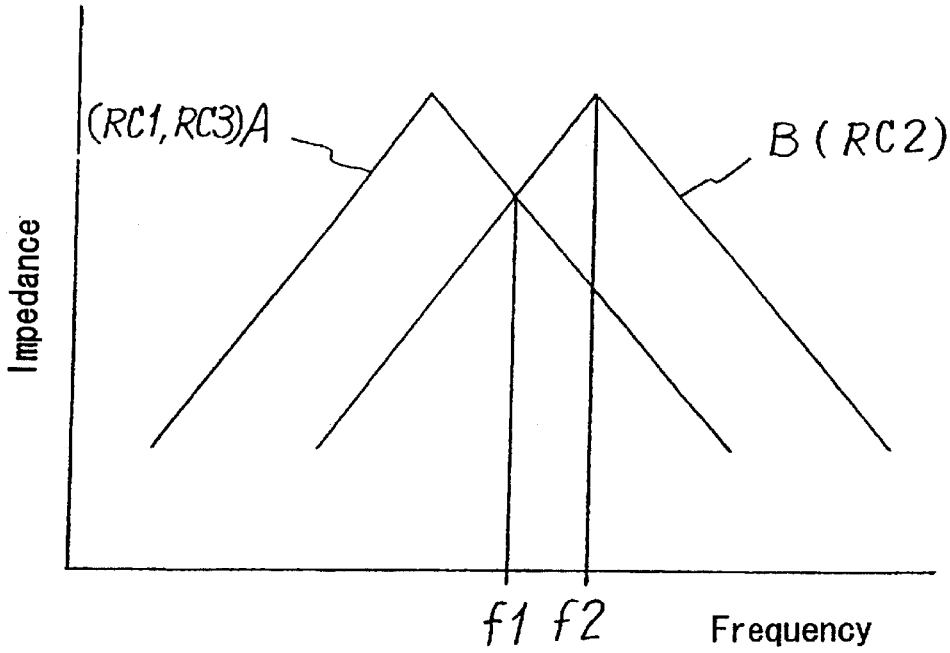
FIG. 7 is a graph illustrating the resonance characteristics of three resonance circuits in a heating roller apparatus according to a second embodiment of the present invention.

FIG. 7 is a graph illustrating the resonance characteristic of three resonance circuits in a heating roller apparatus according to a second embodiment of the present invention.

In the graph, the horizontal axis represents frequency, and the vertical axis represents temperature.

Figure 8:
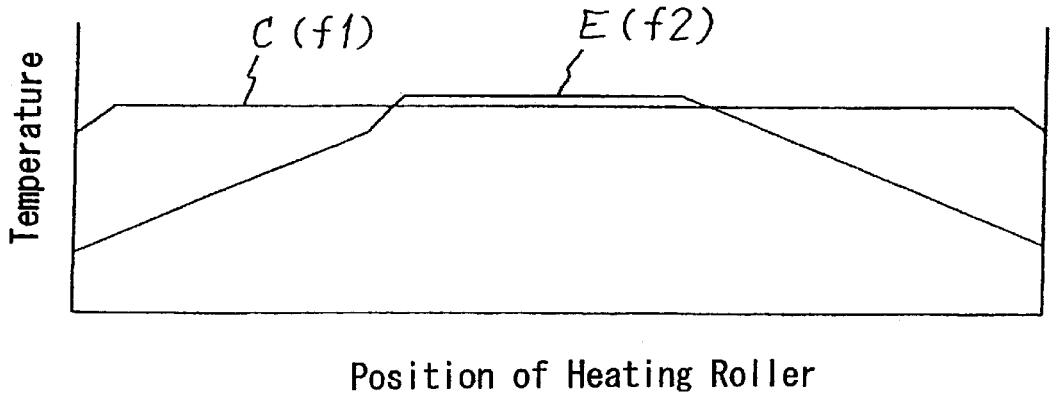
FIG. 8 is a graph illustrating the temperature distribution in the axial direction of the heating roller when the frequency is f1 and f2.

FIG. 8 is a graph illustrating the temperature distribution in the axial direction of the heating roller when the frequency is f1 and f2. In the graph, the horizontal axis represents the position of the heating roller (in the axial direction), and the vertical axis represents the temperature.

In the same manner as the first embodiment, the second embodiment has the three resonance circuits RC1, RC2, RC3. Further, the other elements are the same as the first embodiment except for the resonance characteristics of the resonance circuits RC1, RC2, RC3. The resonance characteristics of the resonance circuits RC1, RC3, which are respectively formed by the induction coils IC1, IC3 and the capacitors C1, C3, are set beforehand as shown by curve A in FIG. 7. Further, the resonance characteristic of the resonance circuit RC2, which is formed by the induction coil IC2 and the capacitor C2 is set beforehand as shown by curve B.

When the frequency is f1, the absolute values of impedance in curves A and B are equal. Thus, the values of the heat amount of the induction coils IC1, IC2, IC3 are substantially equalized in accordance with the high frequency voltage applied thereto. As a result, the temperature of the heating roller HR is uniform substantially along the entire effective length as shown by curve C in FIG. 6.

When the frequency of the high frequency power source FS is changed to f2, the resonance circuit RC2 is substantially biased at the resonance point of the resonance characteristic resonance. However, since the resonance circuits RC1 and RC3 significantly differ from the resonance point, the terminal voltage of the resonance circuit RC2 increases and the terminal voltage of the resonance circuits RC1, RC3 decreases. As a result, the temperature distribution of the heating roller HR is such that the central area is high and the left and right areas are low, as shown by curve E of FIG. 8.

Figure 9:
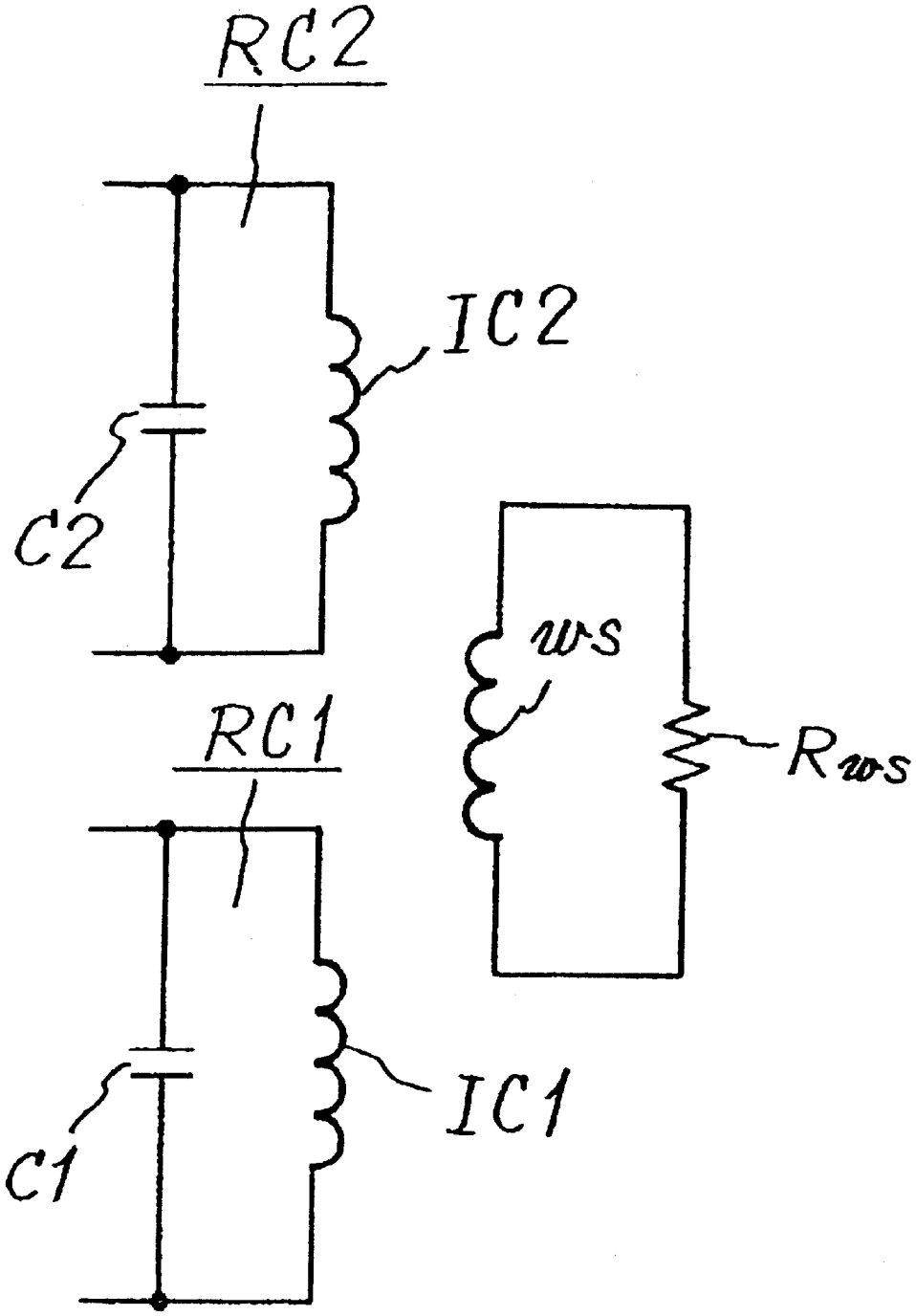
FIG. 9 is a circuit diagram illustrating the relationship between a resonance circuit, which is formed by an induction coil and a capacitor, and a secondary coil in a heating roller apparatus according to a third embodiment of the present invention.

FIG. 9 is a circuit diagram showing the relationship between resonance circuits, which are formed by induction coils and capacitors, and a secondary coil in a heating roller apparatus according to a third embodiment of the present invention. Like or same reference numerals are given to those components that are the same or similar in FIG. 4. Such components will not be described below.

Figure 10:
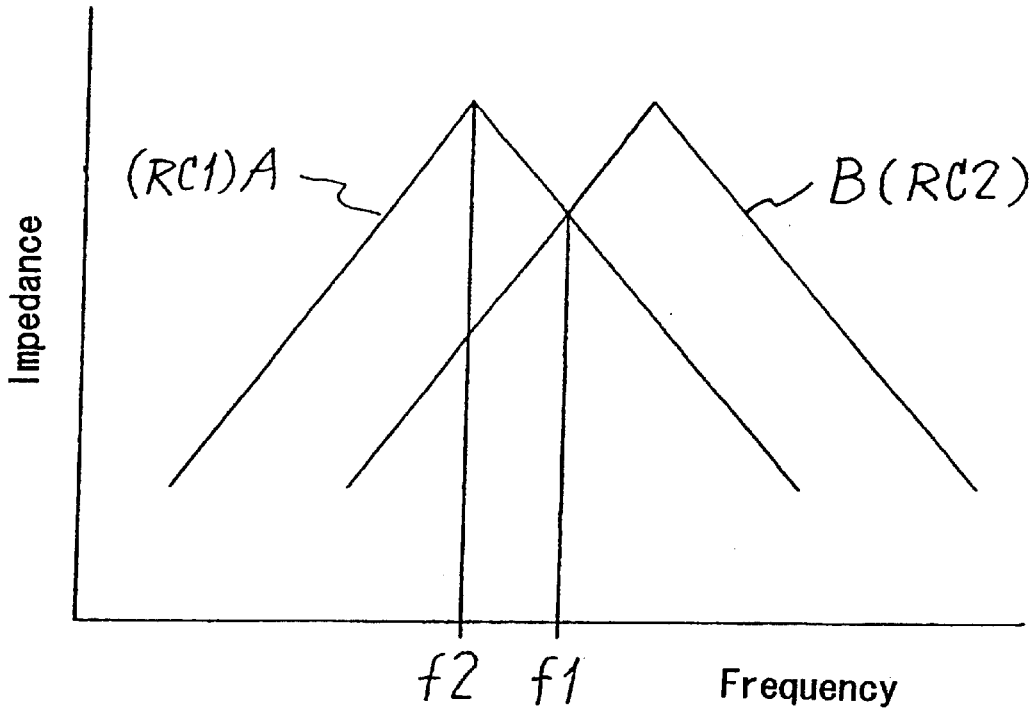
FIG. 10 is a graph illustrating the resonance characteristics of two resonance circuits.

FIG. 10 is a graph illustrating the resonance characteristics of resonance characteristics of the two resonance circuits. In the graph, the horizontal axis represents frequency and the vertical axis represents absolute values of impedance.

Figure 11:
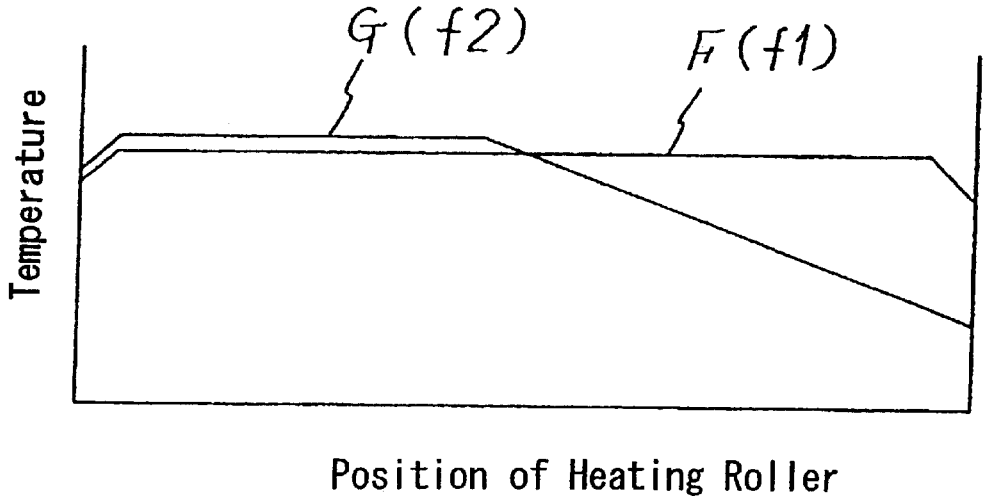
FIG. 11 is a graph illustrating the temperature distribution in the axial direction of the heating roller when the frequency is f1 and f2.

FIG. 11 is a graph illustrating temperature distribution of the heating roller in the axial direction when the frequency is f1 and f2. In the graph, the horizontal axis represents the position of the heating roller (in the axial direction) and the vertical axis represents the temperature.

The third embodiment differs from the above embodiments in that there are two resonance circuits RC1, RC2. In the graph of FIG. 11, curve A represents the resonance characteristic of the resonance circuit RC1, and curve B represents the resonance characteristic of the resonance circuit RC2.

When the frequency is changed to f1, the impedance of the induction coil IC1 is equalized with that of the induction coil IC2. Accordingly, the temperature distribution of the heating roller HR is such that the temperature is substantially uniform along the entire effective length.

When the frequency is changed to f2, the terminal voltage of the induction coil IC1 increases, and the terminal voltage of the induction coil IC2 decreases. Thus, the temperature is high at the left area and low at the right area, as shown by curve G in FIG. 11.

Figure 12:
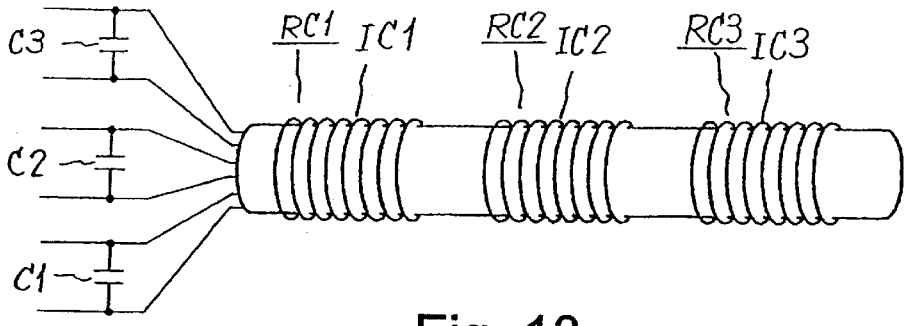
FIG. 12 is a combined perspective view and circuit diagram showing an induction coil and a capacitor in a heating roller apparatus according to a fourth embodiment of the present invention.

FIG. 12 is a combined perspective view and circuit diagram showing induction coils and capacitors in a heating roller apparatus according to a fourth embodiment of the present invention. Like or same reference numerals are given to those components that are the same or similar in FIGS. 2 and 3. Such components will not be described below.

The fourth embodiment differs from the other embodiments in that the capacitors C1, C2, C3 are arranged outside the coil bobbin 8 of the induction coils IC1, IC2, IC3.

Figure 13:
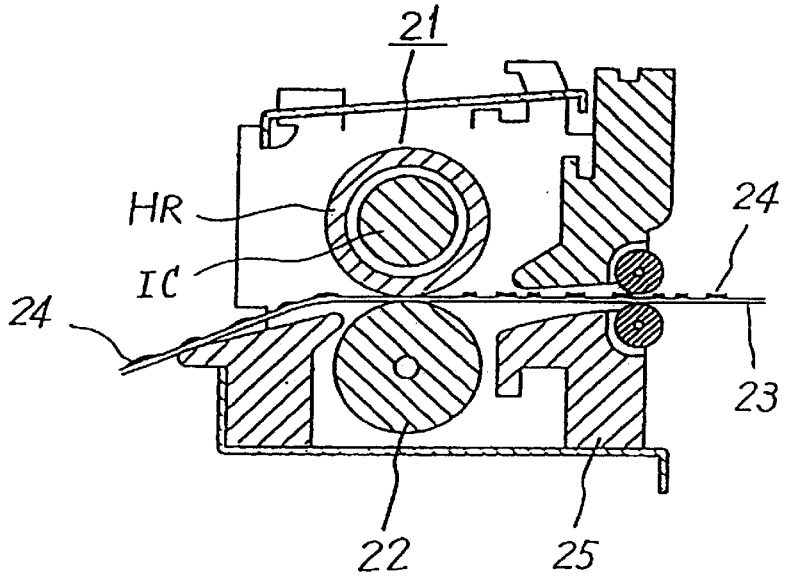
FIG. 13 is a cross-sectional view showing a fixing apparatus according to a preferred embodiment of the present invention.

FIG. 13 is a vertical cross-sectional view of a fixing apparatus according to a preferred embodiment of the present invention.

The fixing apparatus includes an induction heating roller apparatus 21, a pressing roller 22, a recording medium 23, a toner 24, a support 25, and an induction coil IC.

The induction heating roller apparatus 21 is employed in the first embodiment shown in FIGS. 1 to 5.

The pressing roller 22 is arranged to press the heating roller HR of the induction heating roller apparatus 21. The pressing roller 22 transfers a recording medium by clamping the recording medium 23 with the heating roller HR.

A toner 24 is applied to the surface of the recording medium 23 to form an image.

The support 25 holds each element (excluding the recording medium) at predetermined positions.

In the fixing apparatus, the recording medium 23, on which the toner 24 is applied to form an image, is inserted between the heating roller HR of the induction heating roller apparatus 21 and the pressing roller 22. Further, the heating roller HR heats and melts the toner 24 to perform thermal fixing.

Figure 14:
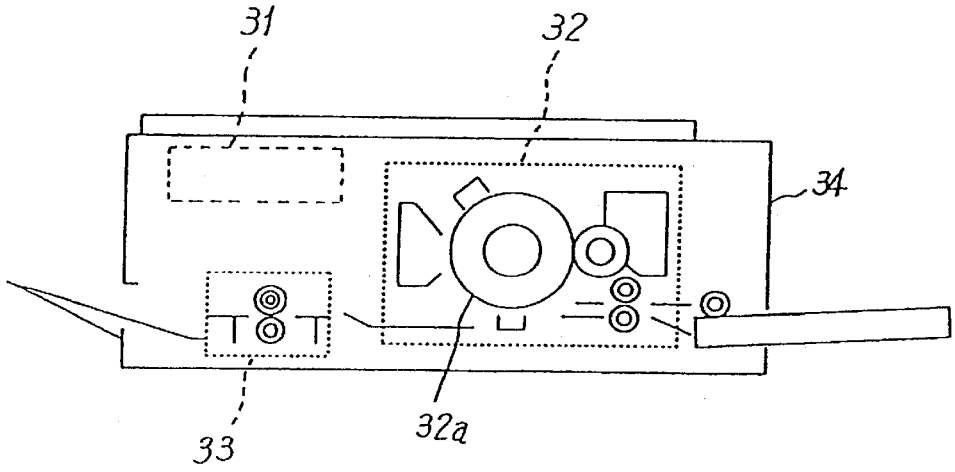
FIG. 14 is a schematic cross-sectional of a copy machine serving as an image formation apparatus according to the present invention.

FIG. 14 is a schematic cross-sectional view of a copying machine, which serves as an image formation apparatus according to a preferred embodiment of the present invention.

The copying machine includes a reading apparatus 31, an image formation means 32, a fixing apparatus 33, and an image formation apparatus case 34.

The reading apparatus 31 optically reads an original paper and generates image signals.

The image formation means 32 forms an electrostatic latent image on a photosensitive drum 32*a* from the image signals and applies the toner to the electrostatic latent image to form a reversed image. The image formation means 32 than transcribes the image on a recording medium, such as paper.

The fixing apparatus 33 heats and melts the toner applied to the recoding medium to perform thermal fixing.

The image formation apparatus case 34 accommodates the above apparatuses including the reading apparatus 31, the image formation means 32, and the fixing apparatus 33. Further, the image formation apparatus includes a transfer apparatus, a power supply apparatus, and a control apparatus.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. An induction heating roller apparatus comprising:

a heating roller;

a plurality of induction coils arranged separately along an axial direction of the heating roller, wherein the heating roller includes a secondary coil that is air-core transfer coupled to the induction coils; and a plurality of capacitors, each being connected to one of the induction coils to form a resonance circuit, wherein at least one of the resonance circuits has a resonance point that differs from the remaining resonance circuits.

2. The induction heating roller apparatus according to claim 1, wherein the capacitors are separated from the heating roller.

3. The induction heating roller apparatus according to claim 1, further comprising:

a variable frequency type high frequency power source electrically connected to the induction coils to supply the induction coils with high frequency power.

4. The induction heating roller apparatus according to claim 1, wherein the plurality of induction coils includes three induction coils, and the plurality of capacitors includes three capacitors, the three induction coils and the three capacitors forming three resonance circuits, respectively, wherein a first resonance circuit has a resonance point that differs from that of second and third resonance circuits.

5. The induction heating roller apparatus according to claim 4, wherein the induction coil and the capacitor forming the first resonance circuit are arranged near a longitudinal end of the heating roller.

6. The induction heating roller apparatus according to claim 4, wherein the induction coil and the capacitor forming the first resonance circuit are arranged in a longitudinally central portion of the heating roller.

7. The induction heating roller apparatus according to claim 1, wherein the plurality of induction coils includes two induction coils, and the plurality of capacitors includes two capacitors, the two induction coils and the two capacitors forming two resonance circuits, respectively, wherein the two resonance circuits have different resonance points.

8. A fixing apparatus comprising:

a pressing roller;

an induction heating roller apparatus including a heating roller pressed by the pressing roller, wherein the induction heating roller apparatus holds a recording medium, on which a toner image is formed, between the pressing roller and the heating roller to transfer the recording medium and fix the toner image on the recording medium, the induction heating roller including:

a plurality of induction coils arranged separately along an axial direction of the heating roller, wherein the heating roller includes a secondary coil that is air-core transfer coupled to the induction coils; and a plurality of capacitors, each being connected to one of the induction coils to form a resonance circuit, wherein at least one of the resonance circuits has a resonance point that differs from the remaining resonance circuits.

9. The fixing apparatus according to claim 8, wherein the capacitors are separated from the heating roller.

10. The fixing apparatus according to claim 8, wherein the induction heating roller apparatus further includes a variable frequency type high frequency power source electrically connected to the induction coils to supply the induction coils with high frequency power.

11. The fixing apparatus according to claim 8, wherein the plurality of induction coils includes three induction coils, and the plurality of capacitors includes three capacitors, the three induction coils and the three capacitors forming three resonance circuits, respectively, wherein a first resonance circuit has a resonance point that differs from that of second and third resonance circuits.

12. The fixing apparatus according to claim 11, wherein the induction coil and the capacitor forming the first resonance circuit are arranged near a longitudinal end of the heating roller.

13. The fixing apparatus according to claim 11, wherein the induction coil and the capacitor forming the first resonance circuit are arranged in a longitudinally central portion of the heating roller.

14. The fixing apparatus according to claim 8, wherein the plurality of induction coils includes two induction coils, and the plurality of capacitors includes two capacitors, the two induction coils and the two capacitors forming two resonance circuits, respectively, wherein the two resonance circuits have different resonance points.

15. An image formation apparatus comprising:

an image formation unit for forming a toner image on a recording medium; and a fixing apparatus for transferring a recording medium, on which a toner image is formed, and fixing the toner image on the recording medium;

the fixing apparatus including:

an induction heating roller apparatus having:

a pressing roller; and a heating roller pressed by the pressing roller, wherein the induction heating roller apparatus holds a recording medium, on which the toner image is formed, between the pressing roller and the heating roller to transfer the recording medium and fix the toner image on the recording medium, the induction heating roller apparatus having:

a plurality of induction coils arranged separately along an axial direction of the heating roller, wherein the heating roller includes a secondary coil that is air-core transfer coupled to the induction coils; and a plurality of capacitors, each being connected to one of the induction coils to form a resonance circuit, wherein at least one of the resonance circuits has a resonance point that differs from the remaining resonance circuits.

16. The image formation apparatus according to claim 15, wherein the capacitors are separated from the heating roller.

17. The image formation apparatus according to claim 15, wherein the induction heating roller apparatus further includes a variable frequency type high frequency power source electrically connected to the induction coils to supply the induction coils with high frequency power.

18. The image formation apparatus according to claim 15, wherein the plurality of induction coils includes three induction coils, and the plurality of capacitors includes three capacitors, the three induction coils and the three capacitors forming three resonance circuits, respectively, wherein a first resonance circuit has a resonance point that differs from that of second and third resonance circuits.

19. The image formation apparatus according to claim 18, wherein the induction coil and the capacitor forming the first resonance circuit are arranged near a longitudinal end of the heating roller.

20. The image formation apparatus according to claim 18, wherein the induction coil and the capacitor forming the first resonance circuit are arranged in a longitudinally central portion of the heating roller.

21. The image formation apparatus according to claim 15, wherein the plurality of induction coils includes two induction coils, and the plurality of capacitors includes two capacitors, the two induction coils and the two capacitors forming two resonance circuits, respectively, wherein the two resonance circuits have different resonance points.

* * * * *